United States Patent [19]

Metz

[11] 4,211,025

[45] Jul. 8, 1980

[54] BIORHYTHM CYCLE DISPLAY APPARATUS

[76] Inventor: George F. Metz, 4712 Berwick Dr., San Diego, Calif. 92117

[21] Appl. No.: 949,142

[22] Filed: Oct. 6, 1978

[51] Int. Cl.[2] ..... G09F 11/04

[52] U.S. Cl. ..... 40/495; 40/107

[58] Field of Search ..... 40/107 B, 489, 490, 40/491, 508, 509, 511, 512, 436, 437, 615, 537, 111, 113, 109, 107 R; 33/1 A, 1 B, 1 SC, 1 SD; 35/24 A, 28, 30, 31 B, 31 C, 31 D, 31 E, 34, 28, 41; 235/89; 116/286, 307

[56] References Cited

U.S. PATENT DOCUMENTS

| | | | |
|---|---|---|---|
| 2,521,930 | 9/1950 | McPartlin | 35/30 |
| 3,212,200 | 10/1965 | Lundberg | 35/30 |

FOREIGN PATENT DOCUMENTS

| | | | |
|---|---|---|---|
| 186434 | 8/1956 | Austria | 40/107 B |
| 195669 | 2/1958 | Austria | 40/107 B |

OTHER PUBLICATIONS

"Bio-meter" Advertisement, *Mother Earth News,* No. 40, Jul. 1976.

"Bio-mate" Advertisement, *American Legion Magazine,* Sep. 1978.

*Primary Examiner*—John F. Pitrelli

*Attorney, Agent, or Firm*—Brown & Martin

[57] ABSTRACT

A biorhythm cycle indicator includes a housing having a plurality of substantially sinusoidal shaped windows shaped to define the extremes of a given cycle with an indicator continuously visible within each window indicating the deviation from the norm within the cycle. The indicators comprise markings on the face of a pair of meshed gears driven at a rate defining the cycle with the markings on the face thereof visible within the window. A clock motor is provided for continuously driving the plurality of indicators, each at a rate defined by its cycle. Adjusting knobs and shafts are provided for adjusting the cycle to that of an individual's biorhythm cycle.

8 Claims, 4 Drawing Figures

BIORHYTHM CYCLE DISPLAY APPARATUS

BACKGROUND OF THE INVENTION

The present invention relates to horological instruments and pertains particularly to a biorhythm clock.

It is recognized that as an inherent part of nature, man responds to a number of biological cycles of different durations. Three significant cycles recognized as the biorhythm cycles are (1) the physical cycle of 23 days duration; (2) the emotional cycle of 28 days duration; and, (3) the intellectual cycle of 33 days. It is recognized that these characteristics of an individual vary from maximum to minimum during these cycles. These cycles are understood to begin on the date of birth of the individual and continue throughout the life of the individual.

The most significant parameters during the cycle are the high and low points and the cross over points from the high and low. The cycle begins at a zero level and rises to a maximum after which it drops to the zero level and continues to drop below the zero level and again return to the zero level. The cycle follows a somewhat sinusoidal curve.

Many systems and instruments have been proposed for determining the value of these parameters within a cycle. Many of the prior art systems, however, are unsatisfactory for a number of reasons. Among the problems of the prior art are the complexities of the systems and the need for extensive calculation.

It is therefore desirable that an instrument be available which overcomes these problems of the prior art by providing an instrument that is simple and inexpensive and that can be personalized to constantly and continuously indicate the relative positions of the cycle for a particular individual.

SUMMARY AND OBJECT OF THE INVENTION

It is accordingly the primary object of the present invention to overcome the above problems of the prior art.

Another object of the present invention is to provide a calculating instrument that continuously computes and displays the biorhythm cycles of an individual.

In accordance with the primary aspect of the invention, an instrument is provided for continuously calculating and displaying the biorhythm cycles of an individual with means for displaying and indicating the displacement, the nature of the displacement, whether positive or negative, and the cross over point in the cycle for the individual.

BRIEF DESCRIPTION OF THE DRAWING

The above and other objects and advantages of the present invention will become apparent from the following description when read in conjunction with the drawings, wherein.

DETAILED DESCRIPTION OF A PREFERRED EMBODIMENT

Figure 1:
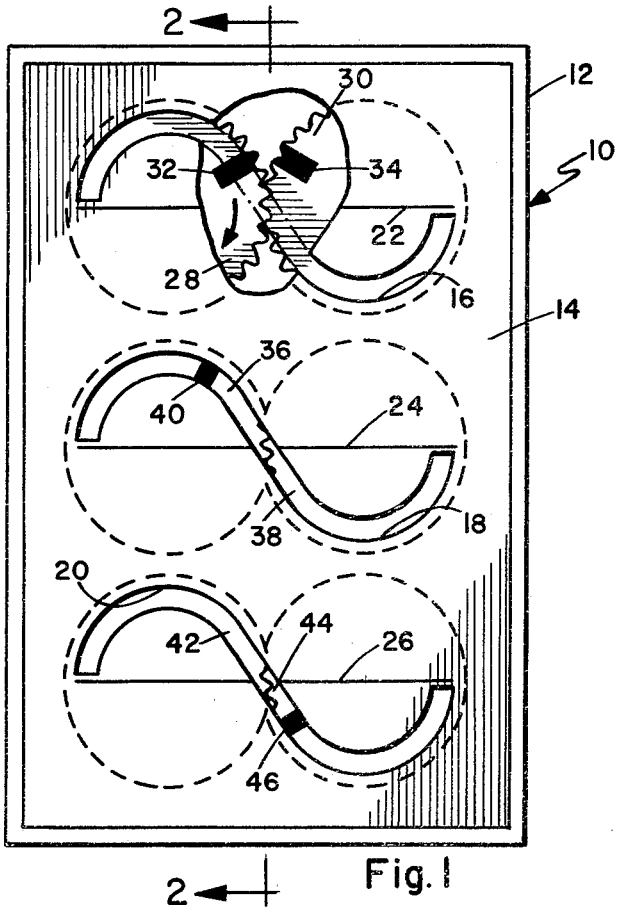
FIG. 1 is a front elevational view of a preferred embodiment of the invention.

Turning to FIG. 1 of the drawing, a biorhythm clock in accordance with the invention is shown designated generally by the numeral 10 and comprising a housing 12 having a generally planar face 14. The clock is arranged to display the three biorhythm cycles of an individual. The display for each cycle consists of a generally transparent window or slot 16, 18 and 20 for each display. The slot or window is of a generally sinusoidal configuration having an arcuate portion extending above a base line 22, 24 and 26, and an arcuate portion extending below the base line for each display. Arcuate portions of the windows are arranged to display peripheral portions of intermeshing gears within the housing.

As best seen in FIG. 1, a pair of discs or gears 28 and 30 are intermeshed and rotate together behind the face of the housing. Peripheral portions of the gears are shown within the slot 16. The gears are disposed in a common plane on parallel axes. Arranged to be viewed through the slot are indicia marks 32 and 34 which may consist of bright colored paint or coating or other suitable material. These marks are arranged to mesh and come together at the intersection of the upper and lower arcs of the window 16. As the gears rotate, the marks 32 and 34 will be displayed alternately within the window 16.

At the beginning of the cycle, the mark 32 will appear at the left hand end of the upper arc and continue across the arc until the two marks come together at the intersection of the two arcs at the base line 22 with mark 34 coming into view and continuing to be visible throughout the lower portion of the arc around the axis of gear 30. Thus, a mark will appear at the left hand end of the sinusoidal slot and continue throughout the slot to the right hand end and disappear at the end of the slot with another mark coming back into view at the beginning of the arc at the far left hand end. Thus, a complete cycle is viewed. The gearing within the clock is such as to drive the gearing such that a mark will traverse the window or slot during the period of the cycle.

The window or slot can have other configurations suitable to show the critical points in the cycle. These critical periods are the high and low points and the cross over points. These can be shown for example by square or Z-wave slots or windows.

The center display window displays portions of gears 36 and 38 therethrough with an indicia mark 40 appearing on gear 36. The indicia mark on gear 38 is not shown within the window. The mark 40 will continue along the arc 18 until it approaches the point of meshing of gears 36 and 38, at which time a mark on gear 38 will appear and as the gears continue to rotate, the mark 40 will disappear behind the face 14 and the mark on gear 38 will continue to be visible along the lower portion of the arc of window 18 until it disappears behind the face thereof.

The lower set of gears are similarly arranged and include gears 42 and 44 intermeshed to rotate together with a mark 46 on gear 44 shown visible in the transparent window 20. The gears are synchronized so that the marks on each gear come together at the intersection of the median line. The mark appears to travel around the upper portion of each slot, cross the median line and continue around the lower portion of the slot. The cycle continues to repeat itself so long as the clock is running.

Figure 2:
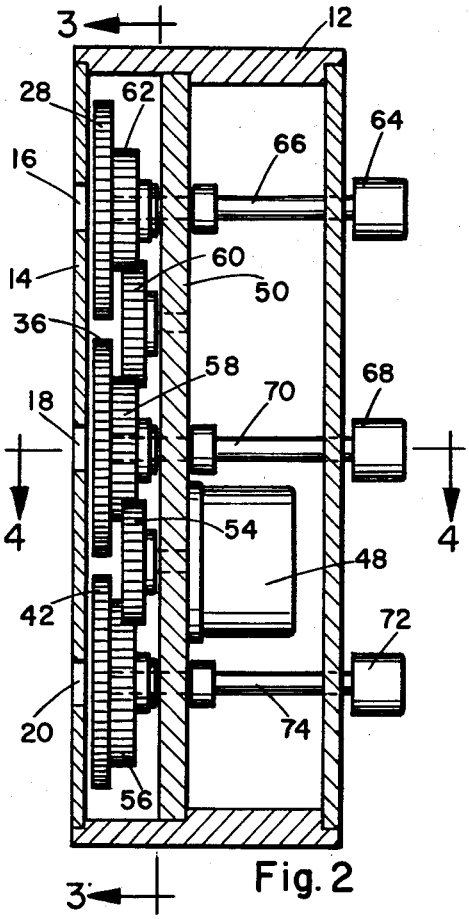
FIG. 2 is a sectional view taken generally on lines 2—2 of FIG. 1.
Figure 3:
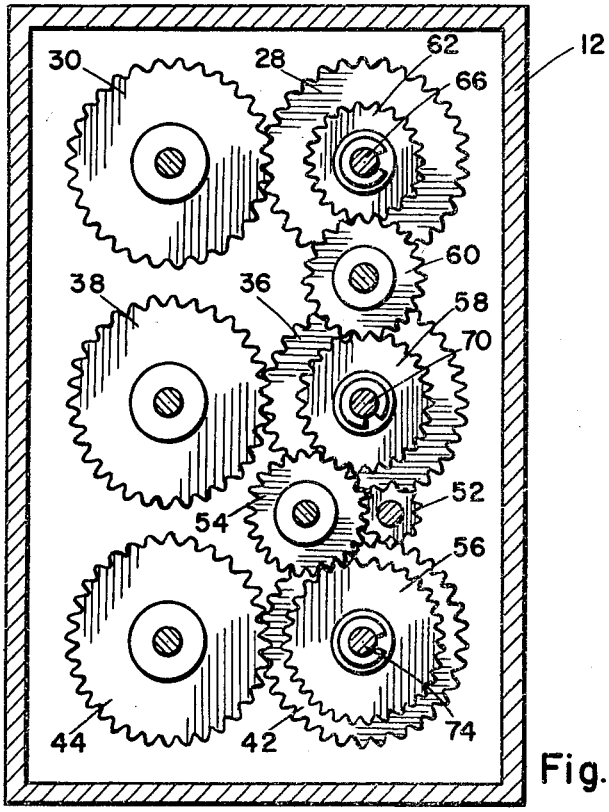
FIG. 3 is a sectional view taken generally on lines 3—3 of FIG. 2.

The drive mechanism for the clock is shown, for example, in FIGS. 2 and 3 and comprises essentially a clock motor 48 mounted within the housing to an inner wall 50 and including a drive pinion 52 as seen in FIG. 3, which is in driving engagement with an idler gear 54 which is in driving engagement with gears 56 on the lower pair of gears 42, 44. A gear 58 is drivingly connected for driving the pairs of gears 36 and 38. An idler gear 60 meshes with gear 58 and with gear 62 for driving the upper pair of gears 28 and 30. The drive gear ratio is such that, for example, the upper display will be driven to provide a physical cycle of 23 days duration with the second or intermediate display being driven at a cycle of 28 days, displaying the emotional cycle, and the lower display displaying a cycle of 33 days representing the intellectual cycle. The arrangement is such as to be driven by a clock motor 48 through the precise gear arrangement which maintains this cycle.

Provision is made in the form of a selective adjusting knob and shaft arrangement 64, 66, 68, 70, and 72, 74 for each pairs of gears. With this arrangement each cycle may be adjusted to suit a particular individual. Once the clock is set for the cycles for a particular individual it will maintain that setting so long as the clock continues to run throughout the life of the individual. Thus, on any particular time, the indicia 32, 34, 40, 46 will begin a position within the window 16, 18 and 20, representative of the condition for that individual for the respective cycles. Thus, once the clock is set and running, the individual need only glance at the face of the clock for each respective cycle to determine the condition for that biorhythm cycle. Each cycle will continue to repeat itself for the period of that cycle. Thus, the gear ratios are such that gears 28 and 30 will make one complete revolution in 23 days, with gears 36 and 38 making a complete revolution in 28 days, and gears 42 and 44 making a complete revolution in 33 days.

Figure 4:
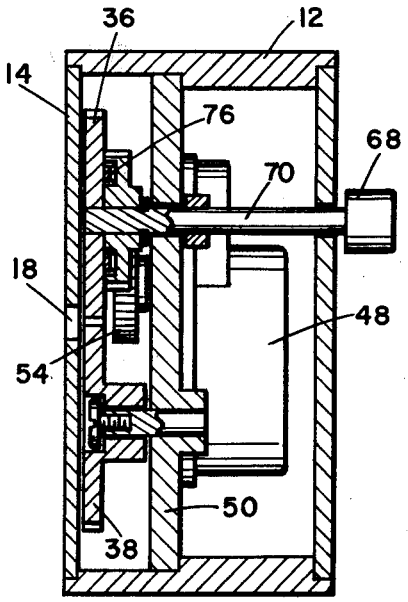
FIG. 4 is a sectional view taken generally on line 4—4 of FIG. 2.

Additional indicia may be formed on the face of the clock which would represent the specific number of days which have passed during the cycle. Such indicia (not shown) may be desirable for the individual. This could be used to facilitate setting the clock, in that an individual could consult a biorhythm table which would indicate the number of days into his cycle the day under consideration falls on. He would then need only set the indicia marker on that day within the cycle. Each of the control knobs 64, 68 and 72 is connected by a shaft directly to the face gear 28, 36 and 42, respectively. The driving connection of the timing and drive for motor 48 is connected through the pinion drive gear by means of a clutch 76 of any suitable form as shown in FIG. 4. This slip clutch 76 permits the face gear to be rotated independently of the drive train so that the indicia may be set for the particular individuals cycle.

From the above description, it will be seen that I have provided a new and novel biorhythm clock arrangement that is simple and effective to use and that provides an easily visible and understood output display. While I have illustrated and described my invention by means of a specific embodiment, it is to be understood that numerous changes and modifications may be made therein without departing from the spirit and scope of the invention as defined in the appended claims.

Having described my invention, I now claim:

1. A time based multicycle display apparatus comprising:

a housing having at least one transparent display window having a shape substantially that of a period of a sine curve arranged to designate the extremes of a cycle;

a pair of rotatable discs disposed in a common plane on parallel axis drivingly connected to rotate together;

indicia means on each of said discs positioned to cooperate within said window to be visible therein to indicate a time related variable of said cycle between the extremes of said cycle, one of said indicia means indicating one portion of said cycle and the other of said indicia means indicating another portion of said cycle.

2. The display apparatus of claim 1, wherein said discs comprise the faces of a pair of substantially identical meshed gears.

3. The display apparatus of claim 1, comprising a plurality of pairs of discs, each pair of discs disposed on adjacent parallel axes and drivingly interconnected, a curved transparent display window for each pair of discs, each window including an arcuate portion partially encircling the axis of each disc, and said indicia means comprises a visible mark on the face of each disc, said indicia means on each disc being arranged to show in said window during half the cycle.

4. The display apparatus of claim 3, comprising:

a clock motor, a drive train drivingly connecting said motor to each of said pairs of discs for driving said discs at different speeds for defining a plurality of cycles of different duration.

5. The display apparatus of claim 4, wherein said plurality consists of three of said pairs of discs, and each pair of said discs define a different human biorhythm cycle.

6. The display apparatus of claim 5, including individual adjusting means for adjusting each pair of discs independently of the other pairs of said discs.

7. The display apparatus of claim 6, wherein said pairs of discs are meshed gears, and said drive train comprises a plurality of gears drivingly connecting said motor to said pairs of gears.

8. The display apparatus of claim 7, wherein said drive train includes a slip clutch for each of said pairs of gears.

* * * * *